United States Patent [19]

Otsuka et al.

[11] Patent Number: 4,914,448

[45] Date of Patent: Apr. 3, 1990

[54] MICROWAVE ANTENNA STRUCTURE

[75] Inventors: Takashi Otsuka, Kanagawa; Toshihiro Kikuchi, Tokyo; Katushiro Yamashita, Tokyo; Tomohiko Haga, Tokyo, all of Japan

[73] Assignee: Sony Corporation, Tokyo, Japan

[21] Appl. No.: 277,186

[22] Filed: Nov. 29, 1988

[30] Foreign Application Priority Data

Nov. 30, 1987 [JP] Japan ..... 62-301918
Aug. 12, 1988 [JP] Japan ..... 63-201155

[51] Int. Cl.[4] ..... H01Q 1/42
[52] U.S. Cl. ..... 343/872; 343/700 MS
[58] Field of Search ..... 343/700 MS, 719, 872, 343/873, 840, 781 P, 781 CA, 781 R, 91 Z

[56] References Cited

U.S. PATENT DOCUMENTS 3,349,405 10/1967 Wright ..... 343/872
4,661,821 4/1987 Smith ..... 343/872
4,761,656 8/1988 Cosman et al. ..... 343/719
4,783,666 11/1988 Ast et al. ..... 343/872

FOREIGN PATENT DOCUMENTS 0046805 2/1988 Japan .

*Primary Examiner*—Rolf Hille
*Assistant Examiner*—Doris J. Johnson
*Attorney, Agent, or Firm*—Hill, Van Santen, Steadman & Simpson

[57] ABSTRACT

A microwave planar antenna having an antenna body sandwiched between a radome and a rear cover, a plurality of clips for clipping the peripheral portions of the radome and the rear cover at a plurality of different points and then protective trims for covering the clips and the peripheral portion of the radome and the rear cover without using screws. Thus, productivity of assembly parts, such as the rear cover, protective trims and so on can be increased, efficiency in the assembly process can be increased and the waterproof property can be improved. In addition, it becomes possible to avoid having the protective trims become displaced.

7 Claims, 7 Drawing Sheets

(PRIORT ART)

MICROWAVE ANTENNA STRUCTURE

BACKGROUND OF THE INVENTION

1. Field of the Invention The present invention relates generally to a planar array type microwave antenna for use in receiving, for example, a satellite broadcast and more particularly to a microwave antenna structure.

2. Description of the Prior Art

In the art, a suspended line feed type planar array antenna has been proposed in which a substrate is sandwiched between metal or metallized plastic plates having a number of spaced openings forming a part of radiation elements, operating as a circular polarized wave planar array antenna, in which a pair of excitation probes which are perpendicular to each other, the number of which corresponds to the number of spaced openings, are formed on a common plane and the signals fed to the pair of excitation probes are mixed in phase within the suspended line (in our co-pending U.S. patent applications Ser. No. 888,117 filed on July 22, 1986 and Ser. No. 058,286 filed on June 4, 1987.

Thus, the above-mentioned planar antenna can be reduced in thickness and its mechanical configuration can be simplified. Further, though an inexpensive substrate available on the market is employed as a high frequency use, an antenna gain equal to or larger than that of the planar antenna using an expensive microstrip line can be achieved.

The suspended line can achieve its advantage that it forms a low loss line as a circuit for feeding the planar antenna and also it can be formed on an inexpensive film-shaped substrate, and so on. Further, since this conventional planar antenna utilizes a circular or rectangular wave-guide opening element as a radiation element, it is possible to construct an array antenna which has a small gain deviation over a relatively wide frequency range.

Meanwhile, a so-called patch type microstrip line antenna has been proposed, in order to reduce the thickness of the planar array antenna. Also, this patch type microstrip line antenna can be made high in efficiency and wide in bandwidth by effective use of the suspended line and the thin radiation element, and it can be reduced in thickness and in weight at the same time, as is disclosed in our co-pending U.S. patent application Ser. No. 223,781 filed on July 25, 1988 and Ser. No. 258,728 filed Oct. 7, 1988.

In a suspended line feed type planar array antenna in which a substrate is sandwiched between a pair of metal or metallized plastic plates, the resonance type printed patch radiators are formed on the substrate at positions corresponding to slots formed through one of the metal or metallized plastic plates.

In the planar antenna in which the substrate is sandwiched between the pair of plates, a protective cover, sometimes called a radome, is generally used to protect an antenna body formed of a pair of plates and a substrate from wind, snow or rain. FIG. 1A illustrates such an antenna. In the antenna shown in FIG. 1A, there are shown a radome 1 and a rear cover 2 between which an antenna body 3 is provided as shown in FIG 1. A packing 4 is inserted between the radome 1 and the rear cover 2 to provide a waterproof property, as shown in FIGS. 1A and 1B. In order to fix the radome 1, the rear cover 2 and so on, two protective trims 5 of C-shaped cross section are engaged with the radome 1, the rear cover 2 and so on from the lateral direction, as shown in FIG. 1C. Finally, these protective trims 5 are fastened to the rear cover 2 by screws 6.

In the conventional planar antenna shown in FIGS. 1A to 1C, a through-hole 7 (FIG. 1B) must be formed from the side surface of the rear cover 2 so that the mold structure becomes complicated, the productivity thereof is poor and the cost thereof is increased.

Further, since the protective trims 5 are fastened to the rear cover 2 by the screws in the lateral direction, substantially no force is applied to the end portions of the radome 1 and the rear cover 2 in the up and down direction. Thus, the packing 4 cannot be expected to have sufficient waterproof property.

The two protective trims 5 grip the radome 1 and the rear cover 2. In this case, as shown in FIG. 1C, the length of the protective trim 5 is increased so that a large draft is needed to mold the protective trim 5. Thus, the protective trims 5 cannot be formed to have a uniform C-shaped cross-section so that the protective trim 5 cannot be fastened to the rear cover 2 without play. Also, the through-hole 7 for the screw 6 must be formed through the side portion of the rear cover 2 so that the mold for molding the protective trim 5 becomes complicated in structure.

Further, since the radome 1 and the rear cover 2 are secured by the protective trim 5 by means of screws 6, tools are needed in the assembly and the efficiency in the assembly process is sluggish.

OBJECTS AND SUMMARY OF THE INVENTION

Accordingly, it is an object of the present invention to provide an improved microwave planar antenna which can obviate the defects encountered with the prior art.

It is another object of the present invention to provide a microwave planar antenna which can increase productivity of its assembly parts such as a rear cover and protective trims.

It is a further object of the present invention to provide a microwave planar antenna which can increase efficiency in the assembly process thereof.

It is a yet further object of the present invention to provide a microwave planar antenna which can increase its waterproof property.

It is a still further object of the present invention to provide a microwave planar antenna which can prevent its protective trims from becoming displaced.

According to an aspect of the present invention, there is provided a microwave planar antenna in which an antenna body is sandwiched between a radome and a rear cover, the peripheral portions of the radome and the rear cover are clipped at a plurality of different points by a plurality of clips and the clips and the peripheral portions of the radome and the rear cover are covered with protective trims made of elastic material without screws. Thus, throughholes for screws are not formed through the side wall of the rear cover so that the rear cover and the protective trims can be produced by means of simple mold core, increasing productivity. Also, the radome and the rear cover can be fixed by the clips in a one-touch fashion so that efficiency in the assembly process thereof can be increased.

These, and other objects, features and advantages of the present invention will become apparent from the following detailed description o the preferred embodiment, to be taken in conjunction with the accompanying drawings, throughout which like reference numerals identify like elements and parts.

DETAILED DESCRIPTION OF THE PREFERRED EMBODIMENTS

Embodiments of an antenna according to the present invention will now be described in detail with reference to FIGS. 2 to 8.

Figure 1A:
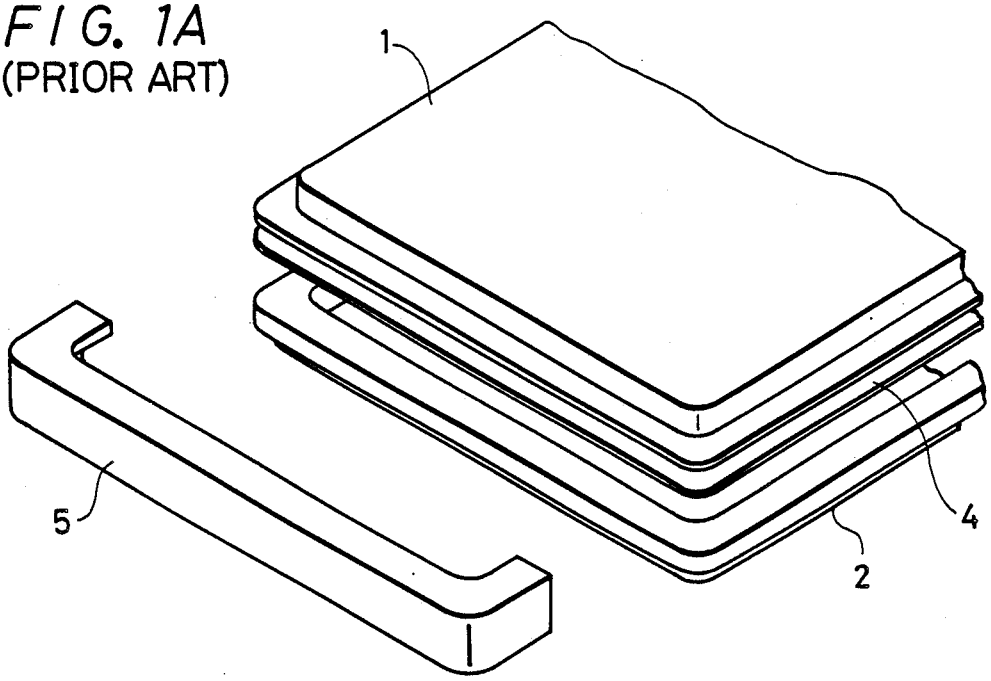
FIG. 1A (PRIOR ART)
FIGS. 1A to 1C are exploded views used to explain the assembly process of a conventional antenna.
Figure 1B:
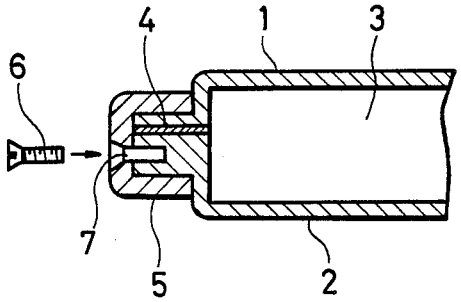
FIG. 1B (PRIOR ART)
Figure 1C:
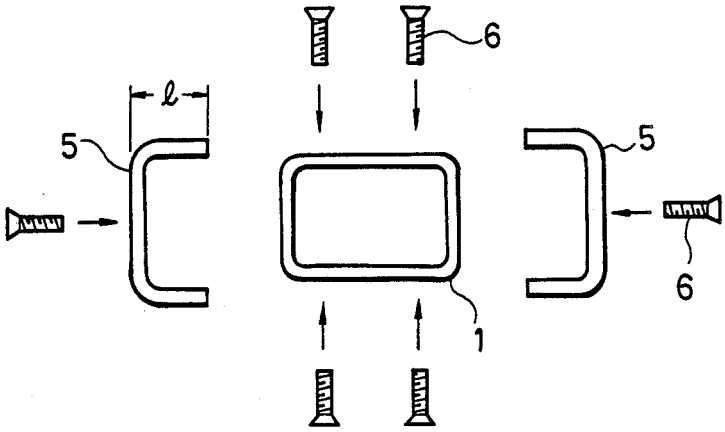
Figure 2:
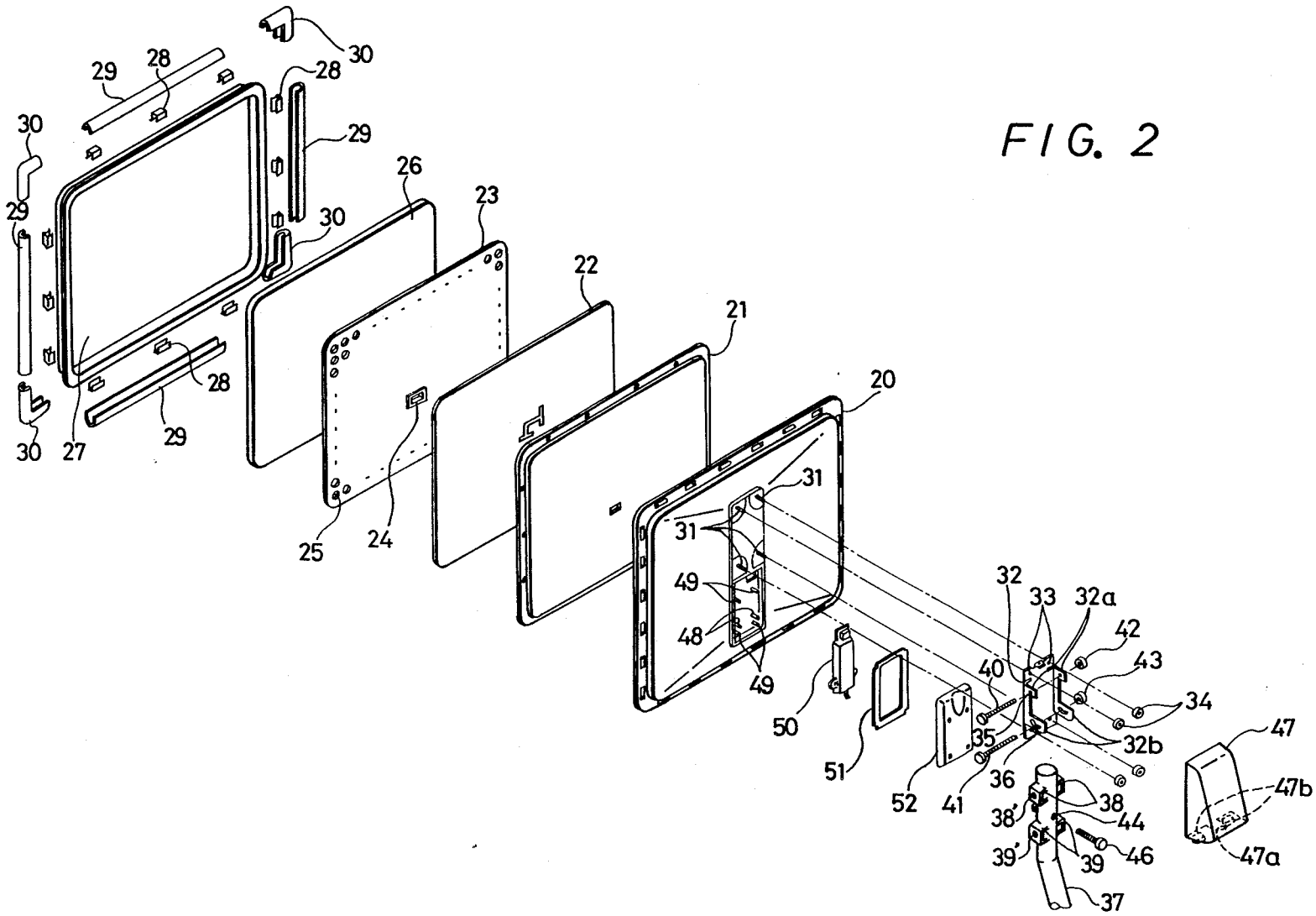
FIG. 2 is a perspective exploded view used to explain the assembly process of an example of an antenna according to the present invention.

FIG. 2 illustrates an assembling state of this embodiment. Referring to FIG. 2, there is shown a rear cover 20, and a bottom plate 21 made of metal or metallized plastic is provided on the rear cover 20. A film-shaped substrate 22 is provided on the bottom plate 21. This filmshaped substrate 22 has resonance type printed patch radiators (not shown) printed thereon (see U.S. patent application Ser. No. 223,781). Further, a top plate 23 made of metal or metallized plastic is formed on the filmshaped substrate 22. A wave-guide cap (upper wave-guide) 24 is provided on the top plate 23 at its position near the center thereof aligned with the feeding point formed on the film-shaped substrate 22. A plurality of slots 25 are formed through the top plate 23 aligned with the resonance type printed patch radiators formed on the film-shaped substrate 22.

A support cushion 26 made of, for example, low-foaming styrol is provided on the top plate 23 and a radome 27 covers the assembly over the support cushion 26. A plurality of clips 28 are engaged with the peripheral portions of the rear cover 20 and the radome 27 in order to secure the rear cover 20 and the radome 27. A plurality of first elastic straight-line protective trims 29 and a plurality of second elastic protective corner trims 30 are attached on the plurality of clips 28.

The rear cover 20 has a number of bolts 31 embedded in advance into its rear wall. These bolts 31 are engaged with openings 33 of a movable pedestal 32 and fastened by nuts 34, thus securing the movable pedestal 32 to the rear cover 20. The movable pedestal 32 has a pair of projected portions **32*a* projected rearwards from its upper portion and a pair of projected portions 32*b* projected rearward from its lower portion which are slightly larger than the former. The projected portions 32*a* respectively have openings 35 bored therethrough and the projected portions 32*b* respectively have slots 36 formed therethrough. A pole 37, to which the movable pedestal 32 is attached has a pair of pole supporting members 38 and 39 formed thereon at its positions corresponding to the projected portions 32*a* and 32*b* of the movable pedestal 32. These supporting members 38 and 39 have through-holes 38' and 39' bored therethrough and also through the pole 37 at their positions corresponding to the openings 35 of the projected portion 32*a* and the slots 36 of the projected portions 32*b*. Then, the openings 35 and the through-holes 38' are aligned and also the slots 36 and the through-holes 39' are aligned through which bolts 40 and 41 are inserted and then fastened by nuts 42 and 43, thus the movable pedestal 32 is mounted on the pole 37. When the movable pedestal 32 is moved under the condition that the nuts 42, 43 are loosened, the movable pedestal 32 can be rotated around the bolt 40 in a range of the slots 36**, thus coarse adjusting an elevation-angle of the antenna body.

The pole 37 has a through-hole 44 bored therethrough at the position between its supporting members 38 and 39. Also, the pole 37 has a nut 45 fixed thereto by welding or the like at its one side opposite to the through-hole 44. An elevation-angle fine adjusting bolt 46 is inserted into the nut 45 from above through the through-hole 44 and engaged with the nut 45. When the bolt 46 is being screwed into the nut 45, the top of the bolt 46 comes in contact with the movable pedestal 32. When the bolt 46 is screwed further, under the condition that the nuts 42, 43 are loosened, the movable pedestal 32 is moved in the opposite direction against the pressure of the bolt 46. Thus, it becomes possible to finely adjust the elevation-angle of the antenna body. That is, by the bolt 46, the elevation-angle of the antenna body can be finely adjusted in a range of, for example, 16°.

The pole 37 is curved or inclined near at least its antenna body mounting portion, for example, near the supporting member 39 by a predetermined angle, e.g. 20°. Accordingly, the movable pedestal 32 does not have to be rotated much in order to obtain a predetermined elevationangle of the antenna body and also, the slots 36 may be short, thus making it possible to make the metal fittings of the movable pedestal 32 small in size.

A cover 47 is attached to the movable pedestal 32 so as to cover the movable pedestal 32 and also the top portion of the pole 37. The cover 47 has a cut-away portion **47*a* formed therethrough at its under side to pass the pole 37 therethrough and engaging portions 47*b* formed at both sides of the cut-away portion 47*a* to be engaged with a converter casing 52**.

The rear cover 20 has a pair of bosses 48 and a plurality such as four additional bosses 49 planted on its rear wall. A converter 50 is secured to the pair of bosses 48 by screws (not shown). A packing 51 is provided around the converter 50 and then the converter casing 52 is mounted to the bosses 49 by screws (not shown). The top portion of the converter casing 52 is engaged with the engaging portions **47*b* of the cover 47**.

Figure 3:
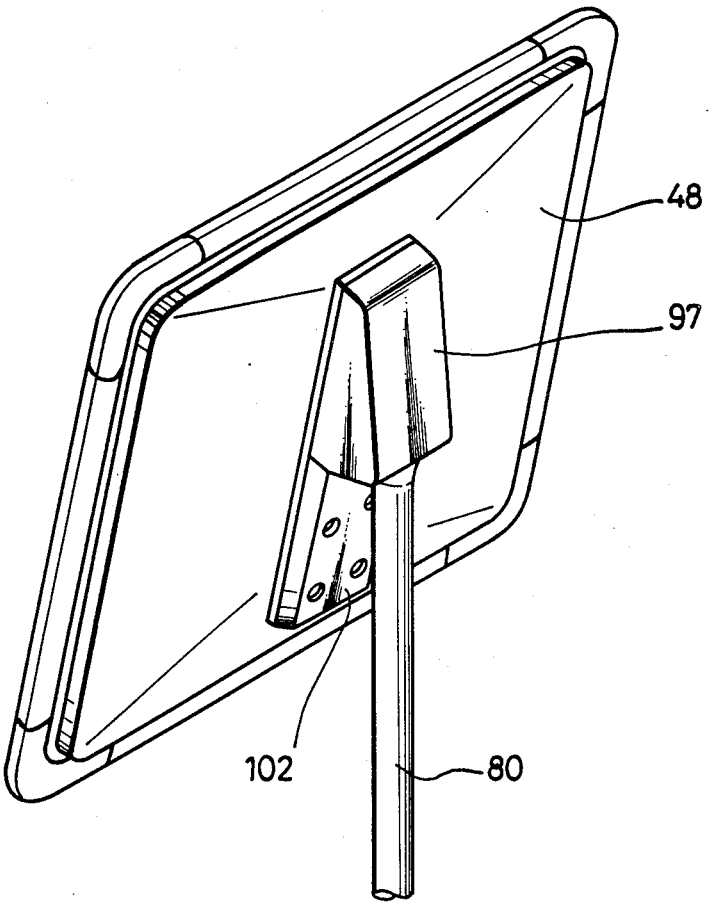
FIG. 3 is a perspective view of a rear side of the antenna of the present invention.

FIG. 3 shows the overall arrangement of the thus assembled antenna apparatus of the present invention as viewed from its rear side. The antenna body is deviated from the vertical direction by a predetermined angle, for example, 10°. Further, since the pole 37 is curved or inclined as described above, the antenna body and the pole 37 are deviated from each other by 20° . Thus, in this case, by using the elevation-angle fine adjusting bolt 46, it is possible to vary the elevation-angle of the antenna body in a range of 30° to 46°. It is needless to say that the desired elevation-angle of the antenna body can be determined in response to the receiving condition of radio waves at respective areas.

Figure 4:
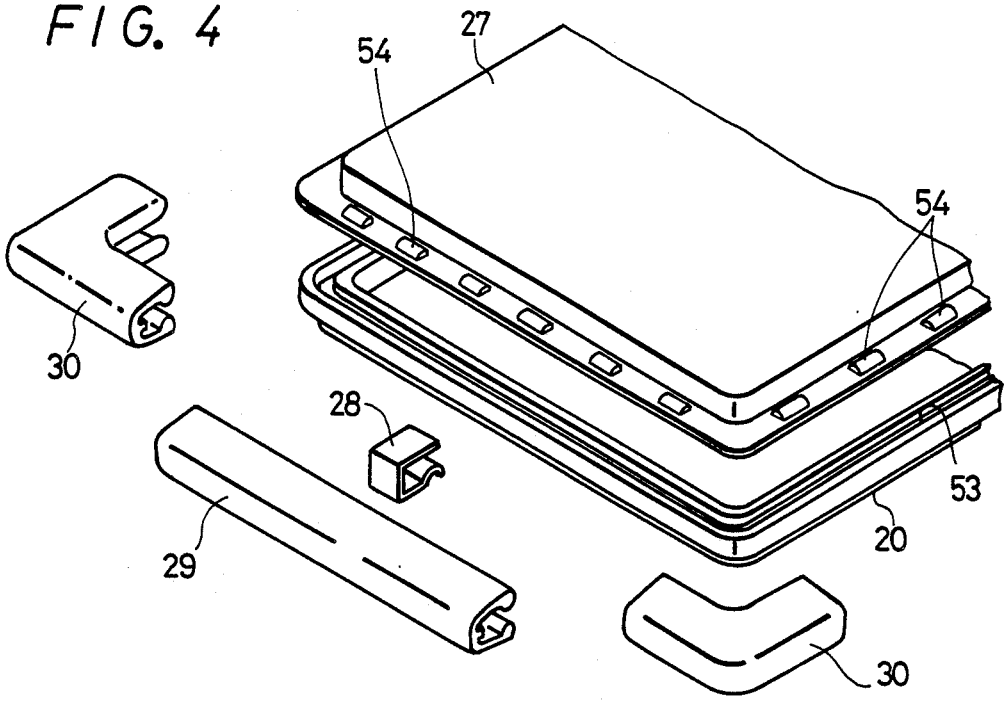
FIG. 4 and FIGS. 5A and 5B are diagrams of an example of how to mount the main assembly parts of the antenna according to the present invention.
Figure 5A:
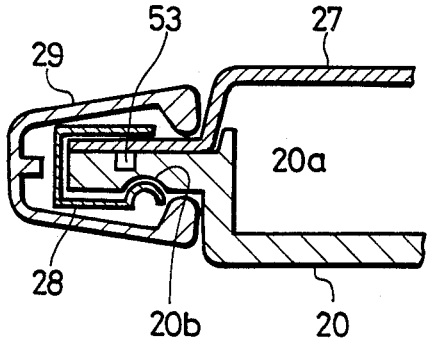
Figure 5B:
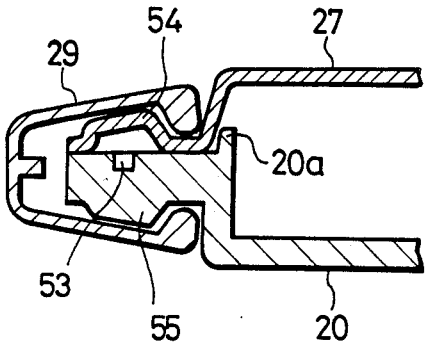

FIG. 4 and FIGS. 5A and 5B illustrate in greater detail a practice in which protective trims and clips are attached to the rear cover and the radome.

As shown in FIG. 4, the rear cover 20 has a waterproof groove 53 of a predetermined shape therearound. This waterproof groove 53 is adapted, when the radome 27 and the rear cover 20 are closely connected, to interrupt surface tension of water, thus keeping the waterproof property. Further, protrusions 54 are formed on the peripheral portion of the radome 27 to engage with the protective trims 29 or 30. Also, protrusions 55 are formed on the peripheral portion of the rear cover 20 to engage with the protective trims 29 or 30 (FIG. 5B). Thus, the protective trims 29 and 30 can be positively fastened to the radome 27 and the rear cover 20 in a one-touch or snap-on fashion without using screws.

As shown in FIGS. 5A and 5B, a positioning rib 20*a* is formed on the inner peripheral portion of the rear cover 20. This positioning rib 20*a* is used to slidably mount the radome 27 on the rear cover 20. The plurality of clips 28 are engaged with the peripheries of the radome 27 and the rear cover 20 at their predetermined positions in a one-touch way in order to fix the radome 27 and the rear cover 20. A clipping concave portion 20*b* is formed on the rear cover 20 in order to positively attach the clips 28 to the radome 27 and the rear cover 20 as shown in FIG. 5A.

Figure 6B:
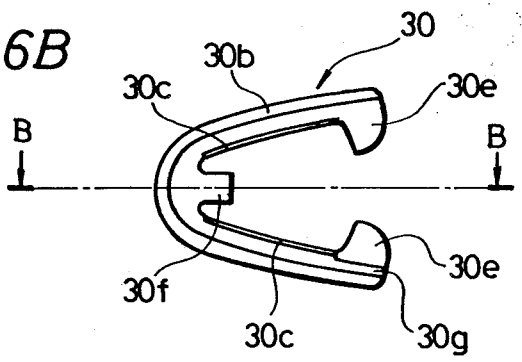
FIGS. 6A to 6D are diagrams of an improved corner trim used in the present invention.
Figure 6D:
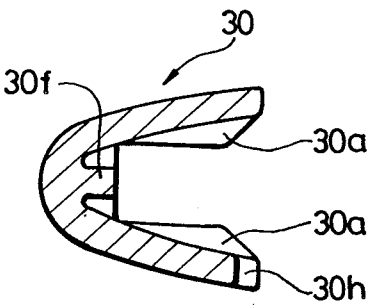
Figure 6A:
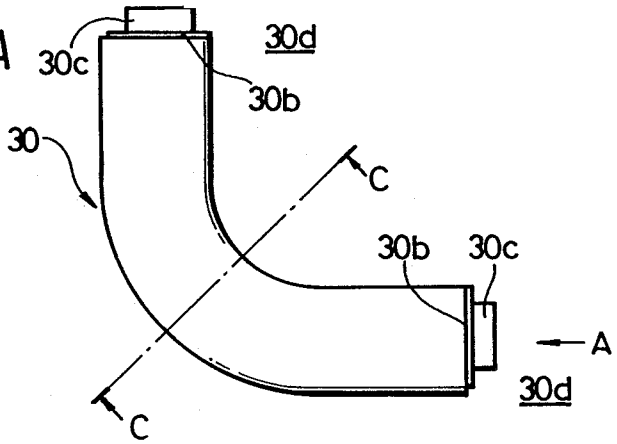
Figure 6C:
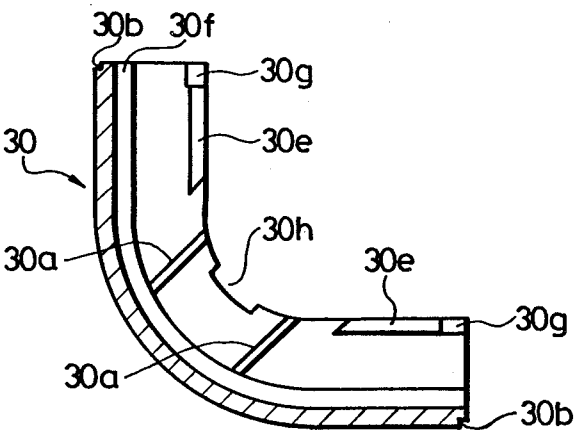

Then, the protective trims 29 and 30 are attached to the radome 27 and the rear cover 20 in a one-touch way and engaged with the protrusions 54 and 55 as shown in FIG. 5B. The protective trims 29 and 30 are divided to provide a predetermined number of protective trims, for example, 8 protective trims, thus lending themselves for suitably being produced as assembly parts. The straight-line protective trims 29 are produced by means of simple extrusion molding, while the corner protective trims 30 are produced by means of injection molding. FIGS. 6A to 6D illustrate an improved example of a structure of each of the corner protective trims 30, respectively. FIG. 6A is a plan view thereof, FIG. 6B is an enlarged view of the protective trim 30 as viewed from the direction shown by an arrow A in FIG. 6A, FIG. 6C is a cross-sectional view taken through the line B—B in FIG. 6B, and FIG. 6D is an enlarged cross-sectional view of the protective trim 30 taken through the line C—C in FIG. 6A.

In this embodiment, as will be clear from FIG. 6C, a plurality of ribs, for example, two ribs 30*a* are provided on the protective trim 30 at its central hollow portion. Owing to the ribs 30*a*, the protective trim 30 can be closely attached to the parts, i.e., the radome 27 and the rear cover 20, thus the protective trim 30 being made difficult to deform and to fall off after having been assembled. Each rib 30*a* decreases its thickness as it goes to its closed edge portion as will be clear from FIG. 6D so that the protective trim 30 can be attached to the radome 27 and the rear cover 20 with ease similarly as described before.

In this embodiment, engaging portions 30*d* are respectively formed on both ends of the body of the protective trim 30. Each of the engaging portions 30*d* is formed of a stepped portion 30*b* and a thin engaging insertion portion 30*c*. Upon assembly, the thin engaging insertion portion 30*c* of the protective trim 30 is inserted into the straight-line protective trim 29 from its end face and the stepped portion 30*b* is brought in contact with the end face of the protective trim 29. Accordingly, when assembled, the thin engaging insertion portion 30*c* cannot be seen from the outside and only the stepped portion 30*b* is seen with a very small difference in level. Since upon assembly, the end faces of the protective trims 30 and 29 are directly brought in contact with each other in the prior art, if they are displaced, the displaced portion becomes conspicuous and awkward. However, according to this embodiment, since the stepped portion 30*b* is positively provided, even if the protective trims 29 and 30 are displaced in position, such a displacement can be substantially alleviated by the stepped portion 30*b* so that such a displacement does not become conspicuous and awkward.

Further, since the thin engaging insertion portion 30*c* of the protective trim 30 is inserted into the protective trim 29 via its end face and positively engaged therewith while positioning itself, it is possible to prevent the protective trims 29 and 30 from being different in level or displaced due to the displaced end face of the protective trim 29.

In FIG. 6, reference number 30*e* denotes a nail portion which is to be engaged with the protrusion 54 (FIG. 4) of the radome 27 and the protrusion 55 (FIG. 5B) of the rear cover 20, 30*f* a convex portion which forms a core of the protective trim 30, 30*g* a positioning opening which is engaged with a protruded portion (not shown) of the rear cover 20 and 30*h* a cut-away portion which is used to remove the protective trim 30.

Figure 7:
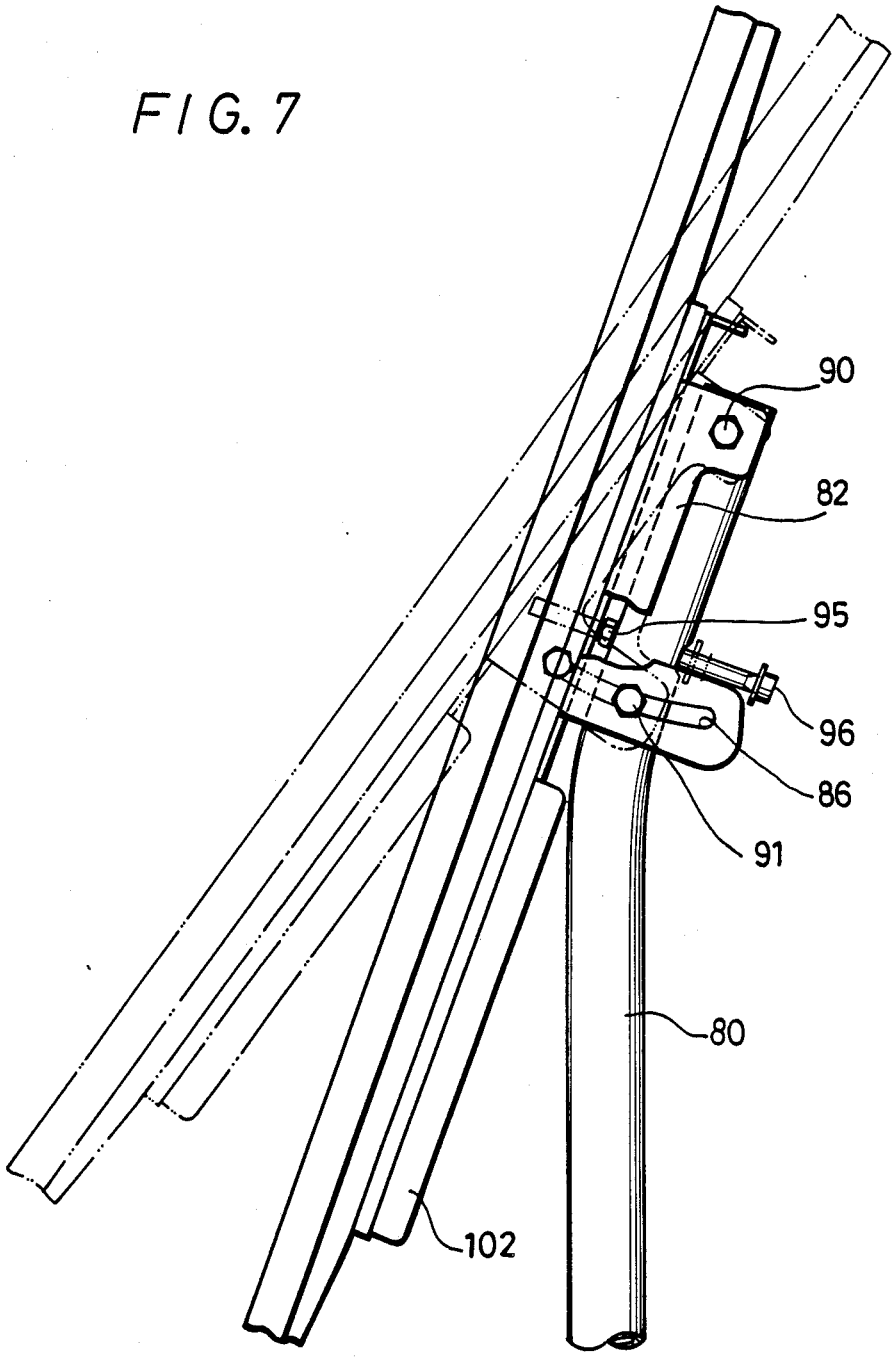
FIG. 7 is an illustration used to explain the adjustment of an elevation-angle of the antenna of the present invention.

FIG. 7 shows how the elevation-angle of the antenna body is varied by the elevation-angle fine adjusting bolt 46 In FIG. 7, the solid line shows the condition that the bolt 46 is loosened fully, and the two-dot chain line shows the condition that the bolt 46 is screwed fully. The process for adjusting the elevation-angle and the azimuth angle of the antenna body will be described below.

First, the pole 37 is temporarily secured, the nuts 42, 43 are loosenly fixed and the movable pedestal 32 is coarse moved so as to select the elevation-angle of antenna body near the angle corresponding to that of the area, for example, about 38° in Tokyo and about 31° in Sapporo. Then, by adjusting the elevation-angle fine adjusting bolt 46, the elevation-angle of antenna body can be set to the value corresponding to that of the area precisely. Then, the pole 37 is rotated to direct the antenna body in the southwest (in the case of Japan), thus coarse adjusting the azimuth angle of the antenna body. Then, a desired radio wave is received and the bolt 46 is again adjusted to finally decide the elevation-angle of the antenna body. Thereafter, fastening the nuts 42 and 43, the movable pedestal 32 is secured to the pole 37. Again, the pole 37 is slightly rotated to finally determined the antenna azimuth angle and the pole 37 is fixed. Thus, the predetermined radio waves can be received positively.

Figure 8:
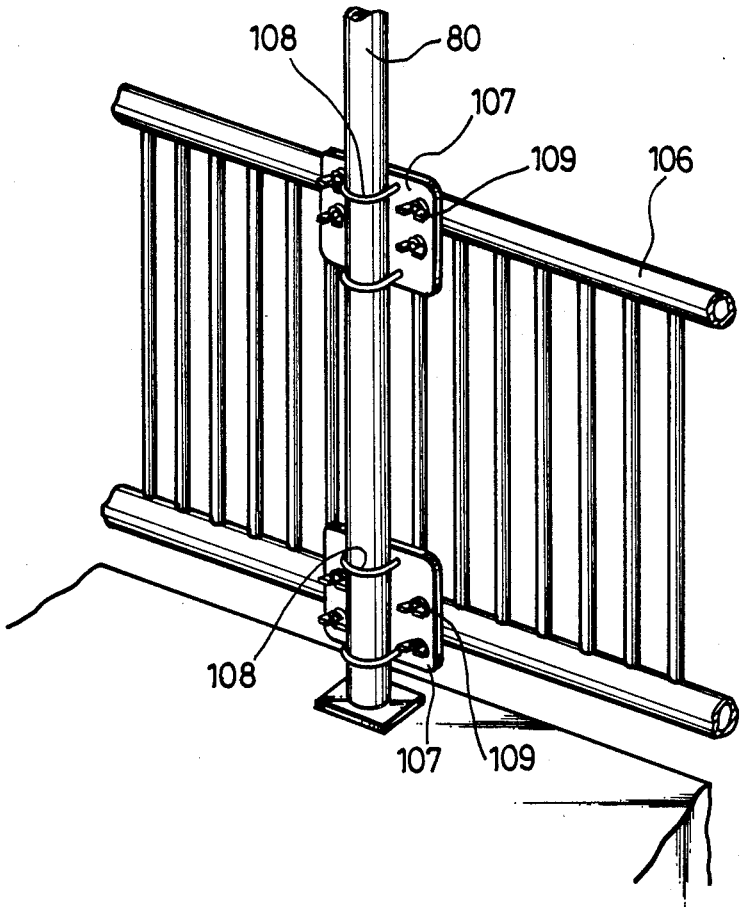
FIG. 8 is a diagram of how to install a pole of the antenna of the present invention.

FIG. 8 illustrates an example of how to install the pole 37. In this example, the pole 37 is installed on a fence 56 of, for example, a veranda facing the south or the like by using fixing plates 57, U-shaped bolts 58 and nuts 59. It is needless to say that the installing method of the pole 37 is not limited to the above-mentioned method.

According to this embodiment, as described above, since the rear cover 20 does not need a screw bore in its lateral direction, the rear cover can be produced by the mold with simple cavity core structure without lateral slider, thus lending itself for increasing the productivity. Also, the efficiency in the assembly process can be increased because the rear cover 20 and the radome 27 are fixed by using clips 28 in a one-touch or snap-on way and the protective trims 29 an 30 are attached to the rear cover 20 and the radome 27 in a one-touch way. Further, since the protective trims 29 and 30 are divided to provide a plurality of straight-line trims and corner trims, the protective trims can be produced as assembly parts with ease, increasing the productivity. Furthermore, since the waterproof groove is formed on the peripheral portion of the rear cover 20, a desired waterproof property can be maintained without using packing.

Since the pole serving as the mounting pedestal is used to form the antenna body and the pole as one body, the number of parts to be assembled of the antenna can be reduced and the construction thereof can be made small. Further, since the fine adjusting mechanism is made integral with the pole, the number of parts to be assembled can be reduced and the adjustment thereof can be performed with ease. In addition, since the pole is curved at its intermediate position, the space occupied by the elevation-angle adjusting mechanism itself can be reduced.

According to the present invention, as set forth above, since the peripheral portions of the radome which encloses the antenna body and the rear cover are fixedly fastened by the clips and then the protective trims are attached to the peripheral portions of the radome and the rear cover without using screws while the ribs are provided on the inner surface of the corner of the protective trim to prevent the protective trim to fall off, the molds for molding the assembly parts such as the rear cover, trims and so on can be simplified in structure and also, the productivity thereof can be increased. At the same time, since the radome and the rear cover are manually fixed by using the clips in a one-touch fashion, the productivity of the antenna body can be increased.

Further, according to the embodiment shown in FIGS. 6A to 6D, the corner protective trim becomes difficult to deform and the protective trim can be prevented from falling off.

Further, since the stepped portion is formed on the engaging portion of the corner protective trim, even if the corner trim and the straight-line trim are displaced from each other, such a displacement can be substantially alleviated by the stepped portion and does not become conspicuous, thus being prevented from becoming awkward from a visual standpoint.

Furthermore, because the thin engaging insertion portion is formed on the end portion of the corner protective trim, the engagement between the corner protective trim, the engagement between the corner trim and the straight-line trim can be improved and a difference in level produced by the positional displacement between the corner trim and the straight-line trim can be avoided.

It should be understood that the above description is presented by way of example on the preferred embodiments of the invention and it will be apparent that many modifications and variations thereof could be effected by one with ordinary skill in the art without departing from the spirit and scope of the novel concepts of the invention so that the scope of the invention should be determined only by the appended claims.

What is claimed is:

1. A microwave planar antenna comprising:

an antenna body sandwiched between a radome and a rear cover, characterized by a plurality of U-shaped clips for securing the peripheral portions of said radome and said rear cover at a plurality of points, and protective trim means for enclosing said clips and said peripheral portions of said radome and said rear cover without using screws.

2. An antenna according to claim 1, wherein said trim means comprises elastic material.

3. An antenna according to claim 2 wherein said antenna body is rectangular in form, and said trim means includes curved corner trim sections and straight-line trim sections.

4. An antenna according to claim 3, wherein each of said corner trim sections is provided with a rib on the inner surface thereof for avoiding the displacement of the corner trim.

5. An antenna according to claim 3, wherein said trim means includes four curved corner trim sections and four straight-line trim sections.

6. An antenna according to claim 3, wherein a boundary line portion between the corner trim section and the straight-line trim section is provided with a step coupling portion.

7. An antenna according to c aim 1 wherein said antenna body includes a substrate on which a plurality of radiators are formed in alignment to form a suspended line feed type planar antenna.

* * * * *